United States Patent [19]

Reinhart, deceased et al.

[11] Patent Number: 4,538,316

[45] Date of Patent: Sep. 3, 1985

[54] PIPE CLEANING EQUIPMENT

[76] Inventors: Alberto J. Reinhart, deceased, late of Düdingen; by Edoardo Reinhart, legal representative, 6777 Quinto; by Fabio Reinhart, legal representative, Piazza Riforma 9, 6900 Lugano, all of Switzerland; by Federico Reinhart, legal representative, Rhodebach 9, D-5135 Selfkant 1, Fed. Rep. of Germany; by Giacomo Reinhart, legal representative, Hauptstrasse 58, 3186 Düdingen, Switzerland; by Pietro Reinhart, legal representative, Raiffeisenstrasse, D-5135 Selfkant-Heilder, Fed. Rep. of Germany

[21] Appl. No.: 489,343

[22] Filed: Apr. 28, 1983

[51] Int. Cl.[3] ..... B08B 9/02

[52] U.S. Cl. ..... 15/104.06 R

[58] Field of Search ..... 15/104.05, 104.06, 104.16, 15/104.18, 104.3 R

[56] References Cited

U.S. PATENT DOCUMENTS

| | | | |
|---|---|---|---|
| 66,387 | 7/1867 | Pratt . | |
| 84,852 | 12/1868 | Beach . | |
| 138,465 | 5/1973 | Ammidoun . | |
| 144,046 | 10/1873 | Armbruster . | |
| 160,203 | 2/1875 | Kees . | |
| 379,564 | 3/1888 | Davison . | |
| 518,638 | 4/1894 | Weston . | |
| 710,798 | 10/1902 | Nowotny . | |
| 748,206 | 12/1903 | Muller . | |
| 812,361 | 2/1906 | Pickles . | |
| 971,042 | 9/1910 | Hill, Jr. et al. | 15/104.06 R |
| 1,077,784 | 11/1913 | Asbury et al. . | |
| 1,181,310 | 5/1916 | Hodgman . | |
| 1,593,072 | 7/1926 | Haydock et al. | 15/104.06 R |
| 2,248,742 | 7/1941 | Burnham . | |
| 2,304,023 | 12/1942 | Sandin . | |
| 2,317,542 | 4/1943 | Lincoln . | |
| 2,657,506 | 11/1953 | Hadley et al. | 15/104.06 R X |
| 2,874,078 | 4/1954 | Reinhart . | |
| 3,130,431 | 4/1964 | Reinhart | 15/104.06 R |
| 3,262,143 | 7/1966 | Reinhart . | |
| 4,173,806 | 11/1979 | Hammelmann . | |

FOREIGN PATENT DOCUMENTS

| | | | |
|---|---|---|---|
| 433832 | 9/1926 | Fed. Rep. of Germany . | |
| 2746668 | 4/1979 | Fed. Rep. of Germany | 15/104.06 |
| 98915 | 5/1940 | Sweden . | |
| 17069 | of 1892 | United Kingdom . | |
| 0633627 | 11/1978 | U.S.S.R. | 15/104.06 R |

*Primary Examiner*—Edward L. Roberts

*Attorney, Agent, or Firm*—Wender, Murase & White

[57] ABSTRACT

The cleaning equipment has at least one cleaning unit and a propelling unit in hinged connection. The cleaning unit has cutting arms pivoted in a head. By means of a compact design of the cleaning unit or units with an axial length of the cutting arms substantially equal to the nominal diameter of the cleaning equipment and of the pipe to be cleaned respectively, by means of cutter arms extending substantially radially near said head, by the use of cutting knives of a substantially triangular sectional shape and having high torsional resistance, and by supporting the cutter arms by strong spring bundles a high cleaning efficiency of the cleaning equipment is obtained.

20 Claims, 14 Drawing Figures

22
22a
3
21
9
11
30
A
a
b
c
d
e
f
g

PIPE CLEANING EQUIPMENT

BACKGROUND OF THE INVENTION

The present invention relates to a pipe cleaning equipment having at least one cleaning unit and a propelling unit for propelling the unit through a pipe line, said cleaning unit having a rim of rigid cutter arms pivotably mounted on a head of the unit. Cleaning equipment of this type is disclosed in U.S. Pat. Nos. 3,130,431 and 3,262,143; the first relates to the cleaning unit and the second to the propulsing or propelling unit.

Cleaning equipment as disclosed in the above references has been used sucessfully for years, but it is extremely difficult to know for sure which features of the cleaning equipment contribute to the cleaning effect of the equipment as a whole. Particularly, it is difficult to determine how such cleaning equipment, and particularly structural elements its cleaning unit, should be constructed in order to clean properly and most efficiently pipe lines having heavy incrustation. The difficulty particularly results from the fact that it is impossible to observe the equipment during its cleaning operation in pipe lines having varying contaminations and incrustations and it is also very difficult to imitate artificially or reconstruct the particular conditions encountered in contaminated and incrustated pipes in order to study systematically the effects of the cleaning equipment and to make improvements based on test results. In other words, it cannot be known in advance which measures may lead to an improvement in the equipment cleaning efficiency.

SUMMARY OF THE INVENTION

This invention relates to various measures bringing each one separately or in combination with each other a substantial and surprising improvement of the cleaning properties and possibilities of application of the cleaning equipment. On one hand it has been found that the cleaning effect and particularly the efficiency of the equipment for removing heavy incrustations in pipe lines may be improved substantially if the cleaning unit is relatively short and compact, so that the axial length of each cutter arm is at least approximately equal to the nominal diameter and axial length of the cleaning unit as well as the pipe to be cleaned. The reasons for the improved efficiency are not obvious because it has been assumed in the past that the prior-art cleaning units having relatively long cutter arms as compared with the nominal diameter of the pipe to be cleaned would act longer distance and over thus for a longer time onto incrustations and would therefore be more efficient in breaking up and removing them, assuming that the cleaning units are fed at a given speed through the pipe lines.

However, it appears that relatively elongated cleaning units wedge in the incrustation due to the relatively small inclination of the cutter arms relative to the axis of the cleaning unit, whereby their efficiency is reduced and they may even seize in the tube. A short and compact cleaning unit appears to have a better chance to break up hard incrustations due to a higher specific pressure of the relatively short cutter arms. Further, a shorter cleaning unit can pass unhindered through tube bends and elbows, thus increasing its versatility and utility for a wide variety of cleaning problems.

It is assumed that the high cleaning efficiency is assisted by the fact that each cutter arm has a radial outer rib extending into close proximity of the pivot point of the cutter arm in the head of the cleaning unit. Preferably, this rib may extend from the pivot point substantially radially outwards. In this case the cutter arms form a relatively steep compact front side of the cleaning unit, whereby they exert force onto the incrustations in an axial rather than in a radial direction; this resulting in breaking up rather than jamming and wedging of the cleaning unit in the incrustation. Therefore, it has been found that one should not rely too much onto a wedging action of slightly inclined cutter knives although intuitively it appears to be quite obvious and promising to make use of this wedging effect.

In order to provide proper suspension of the cutter arms of which the ribs extend substantially radially outwards from the pivot point, the cutter arms are preferably suspended or pivoted in outwardly opening grooves of the head of the cleaning unit, such grooves being partially covered in their fore portion. This allows an arrangement of the cutter knives in a manner having a positive effect onto the cleaning properties.

The compact design of the cleaning units also has the effect that packets or bundles of springs supporting each cutter arm may be arranged relatively steeply and thus will urge the cutter arms outwardly against the tube wall with high contact forces. Preferably the bundles of springs include a number of springs extending into close proximity of each cutter arm whereby the stiffness of the unit and its pressure against the tube wall may be increased. Together with the relatively short and compact design of the cleaning units the high spring forces result in a high specific cutter pressure against the tube wall and therefore improved cleaning effect.

In order to obtain sufficient life time and stability of the cleaning unit in spite of the increased forces, the cutter arms may be made of cast steel and may have a substantially triangular cross section imparting high torsional strength to the cutter arms.

As set out above, this invention aims in providing a cleaning equipment which has a particularly favorable cleaning effect and which has high versatility and may be used for practically all cleaning problems. The short and compact shape of the cleaning unit not only improves its cleaning effect but it allows easy advance of the cleaning unit through curved sections of the pipe line and particularly through pipe bends. Preferably the cutter arms have their full spacing from the axis of the unit outside the anchorage of the leaf springs supporting them, this allowing free inward pivoting of the cutter arms without obstruction by the anchorage of the springs when the cleaning unit passes through bent sections of the pipe line. This free inward pivoting of the cutter arms may further be assisted by the fact that the free end of such cutter arms in the range of the V-shaped cutting kinves is inwardly tapered. For the same purpose it may be advantageous if the ribs of the cutter arms have a substantially straight outer edge between their V-shaped cutting knives and their radially extending fore portions.

The invention will now be explained in detail with reference to the accompanying drawings illustrating by way of example embodiments of the invention.

DESCRIPTION OF THE PREFERRED EMBODIMENT

Figure 1:
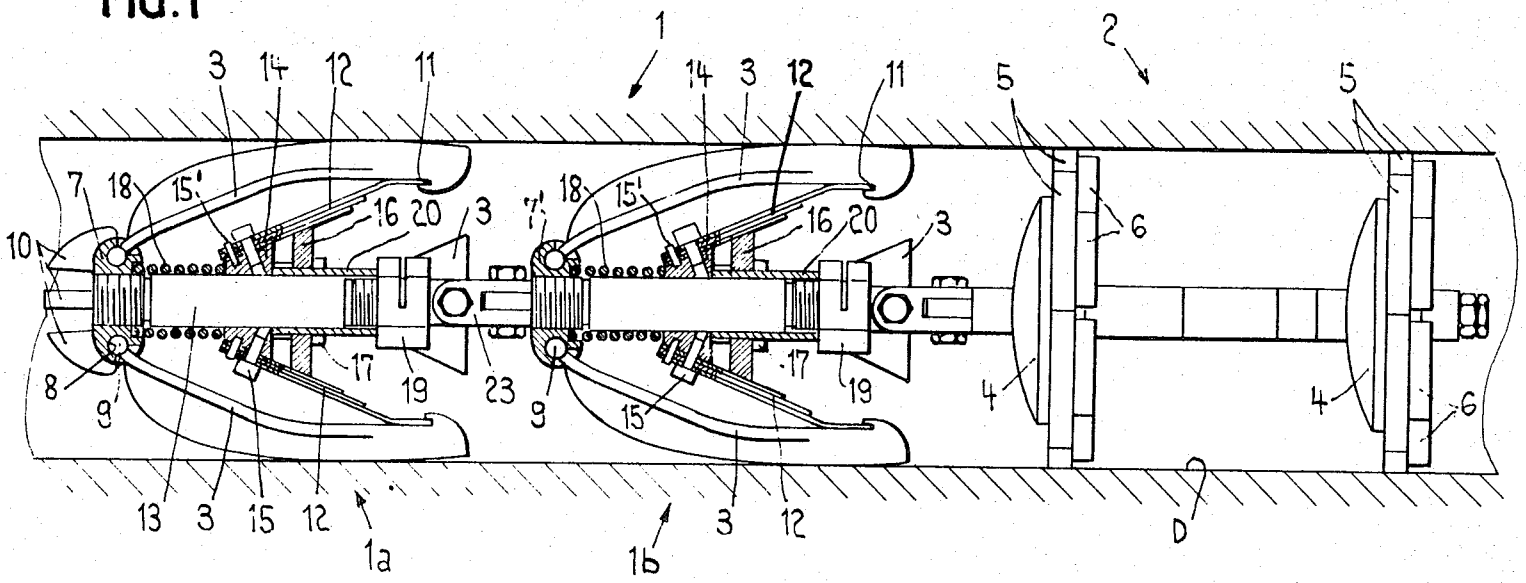
FIG. 1 is a general view, partially in section, of the cleaning equipment.

The cleaning equipment illustrated in FIG. 1 is shown in a pipe having a diameter D. This diameter of the pipe for which the cleaning equipment is destined is equal to the nominal diameter of the equipment. The equipment has a cleaning device 1 and a propelling or propulsion unit 2. While the cleaning device has two cleaning units 1*a* and 1*b* having each a rim of cutter arms 3, the propulsion unit 2 has two disc-shaped pistons having each a supporting plate 4, piston discs 5 of suitable material, preferably leather and weights 6 fixed to the piston discs 5. The propulsion unit is not part of the present invention, and its design and operation substantially correspond to those disclosed in U.S. Pat. No. 3,262,143, which is hereby incorporates herein by reference.

The cleaning unit 1*a* has a head 7 serving as a support for the four cutter arms 3. To this end the head 7 has four grooves 8 each accessible from one side, cylindrical pivot pins 9 of each cutter arm engaging with radial play into one of said grooves 8 wherein it is secured by a screw not illustrated. Pivoting of the cutter arms with radial play allows slight twisting of the cutter arms and adjustment thereof in circumferential direction, whereby they always optimally adapt their position to the surface of the pipe and of an incrustation in the pipe respectively. Undesired rotating movement of the cleaning equipment within the pipe may also be inhibited by this suspension of the cutter arms with radial play. The head 7 has axially projecting ribs 10 serving for breaking and disintegrating contaminations and incrustations reaching into proximity of the pipe axis.

Anchoring grooves 11 are provided at the ends of the cutter arms 3, receiving each the outermost leaf spring of a bundle of leaf springs 12. The bundles of leaf springs are fixed to a support 14 secured to the shaft 13 of the cleaning unit by means of screws 15, pins 15' being inserted for preventing pivoting of the leaf springs. As shown in FIG. 1 the bundles 12 of leaf springs extend into immediate proximity of the supported part of the associated cutter arm 3 such that these cutter arms are urged with substantial spring force radially outwardly towards the pipe wall. The spring force of the spring packets may be adjusted by displacement of a supporting disc 16 by means of screws 17 screwed into the support 14. A pressure spring 18 is inserted between support 14 and head 7, by which the support 14 with the spring packets 12 is normally held in the illustrated position, but in case of very high pressure from outside onto the cutter arms the spring 18 allows inward displacement of the cutter arms and axial forward displacement of the spring packets and the support 14 on shaft 13. The prestress in the spring 18 and in the spring bundles 12 respectively may be adjusted by means of a nut 19 screwed onto a screw-threaded portion of shaft 13 and allowing to axial shift by means of a tube 20 the whole assembly consisting of support 14, spring packets 12 and the supporting disc 16. In this way, adjustment of the radial pressure acting onto the cutter arms and adaptation of the cleaning unit to various kinds and degrees of contamination and incrustation of pipes is possible.

Figures 2, 2A, 2B, 2C, 2D, 2E, 2F, 2G:
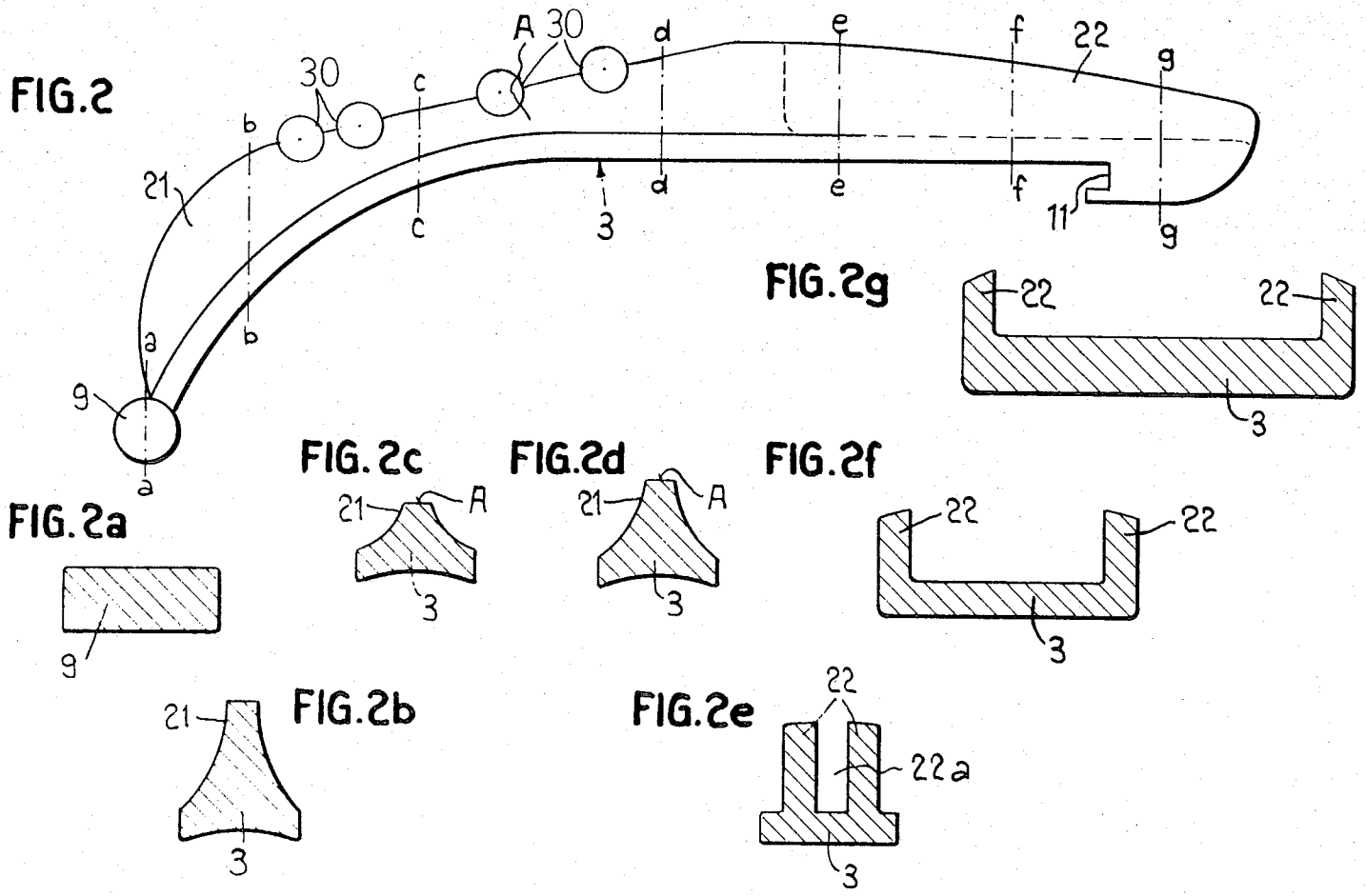
FIG. 2 is a side view of a cutter arm
FIG. 2*a* is a transverse section of the cutter arm taken along a—a of FIG. 2.
FIG. 2*b* is a transverse section of the cutter arm taken along b—b of FIG. 2.
FIG. 2*c* is a transverse section of the cutter arm taken along c—c of FIG. 2.
FIG. 2*d* is a transverse section of the cutter arm taken along d—d of FIG. 2.
FIG. 2*e* is a transverse section of the cutter arm taken along e—e of FIG. 2.
FIG. 2*f* is a transverse section of the cutter arm taken along f—f of FIG. 2.
FIG. 2*g* is a transverse section of the cutter arm taken along g—g of FIG. 2.
Figure 3:
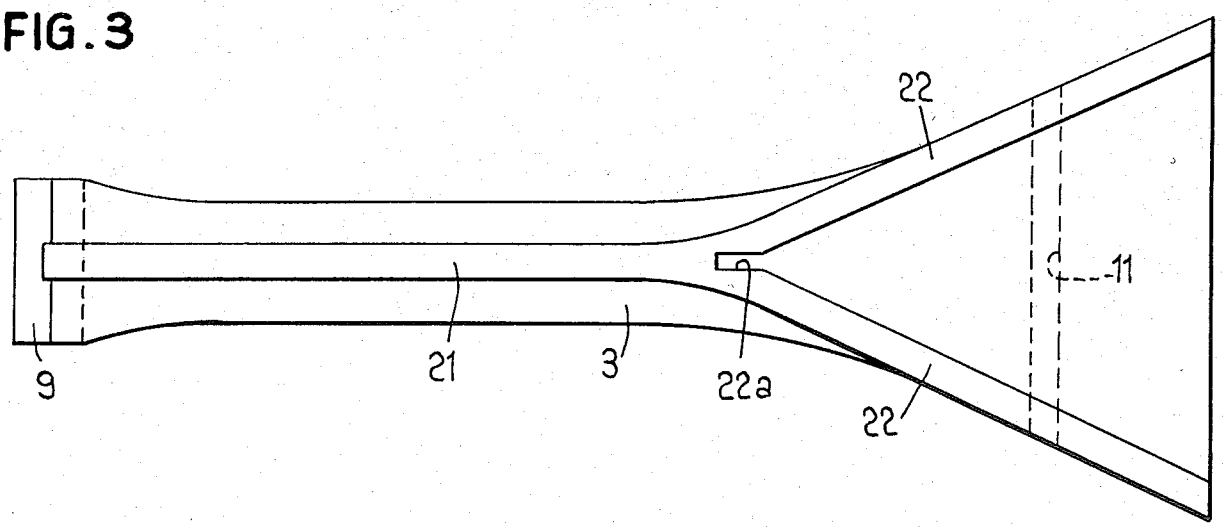
FIG. 3 is a top view of a cutter arm.

The cutter arms 3 have the shape illustrated in FIG. 2. Near the cylindrical pivot pins 9 each cutter arm has a substantially triangular profile which has a high torsional resistance and an outwardly protecting rib 21. Near the pivot pins 9 the rib 21 extends practically radially outwardly, thereby forming a steep front of the cleaning unit, this front entering axially into very thick contaminations or incrustations for breaking them up without being wedged or jammed therein. The cutter arms further have a flatter portion with a substantially straight outer edge A which is split into two ribs 22 extending in V-shape rearwardly to the free end of the cutter arm as shown in FIG. 3. The outer side of ribs 22 is rounded to the nominal diameter of the pipe and of the cleaning equipment respectively. This V-shaped widening part of the cutter arms acts as a wedge for completely splitting up and disintegrating contamination and for scrapping it off the pipe wall. As shown in FIG. 3, a groove 22*a* is formed at the root of the knives 22 this reducing the contact area and increasing the specific pressure with which such knives are urged against the pipe wall for cleaning it.

The second cleaning unit 1*b* has the same construction and operation as the first one and is connected therewith by means of a pair of opposed, hinged knuckles 23. Therefore, these units may be tilted relatively to each other in any desired direction, (i.e., within three degrees of freedom), this facilitating passage of the cleaning equipment through bent pipes. The parts of unit 1*b* are designated similarly as corresponding parts of unit 1*a*. It only differs from unit 1*a* in that the head 7 has no ribs 10. While in FIG. 1 the cutter arms 3 of unit 1*b* are shown in the same planes as the cutter arms of unit 1*a*, such cutter arms may be staggered such that the eight arms are uniformly distributed at the circumference of the pipe wall.

As shown in FIG. 1 each cleaning unit 1*a* and 1b is relatively short and compact. As an example, for a nominal diameter of 250 mm the axial length of the cutter arms is also about 250 mm, that is, the ratio of the length to the diameter is approximately 1:1. As set out above, it has been found that compact shape together with strong and relatively steep spring packets result in a very high cleaning power, whereby the danger of jamming in heavy incrustations or wedging in bent pipe portions is substantially reduced compared with cleaning equipment of relatively elongated shape. The fact that the cleaning units and their cutter arms respectively have ribs extending substantially radially outwards brings an excellent cleaning effect, particularly in pipes with heavy incrustation. This effect may also be explained by the fact that the cleaning units are used together with a very specific propelling unit producing a vibrating propelling force. A further improvement of the cleaning effect may be ascribed to the fact that the cutter arms have relatively slim or high sectional shape at least ahead of their bifurcation. These cutter arms thus form an insignificant obstacle for pulsating water jets flowing under the water pressure from between the piston discs 5 and the pipe wall, the water under pressure being admitted from the right side in FIG. 1. These water jets assist in breaking and disintegrating of contaminatious and flushing thereof forwardly through the pipe. The cutter arms are preferably made of cast steel and are thus not only very strong but have relatively long life due to their relatively high hardness. They also are substantially corrosion proof.

Figure 4:
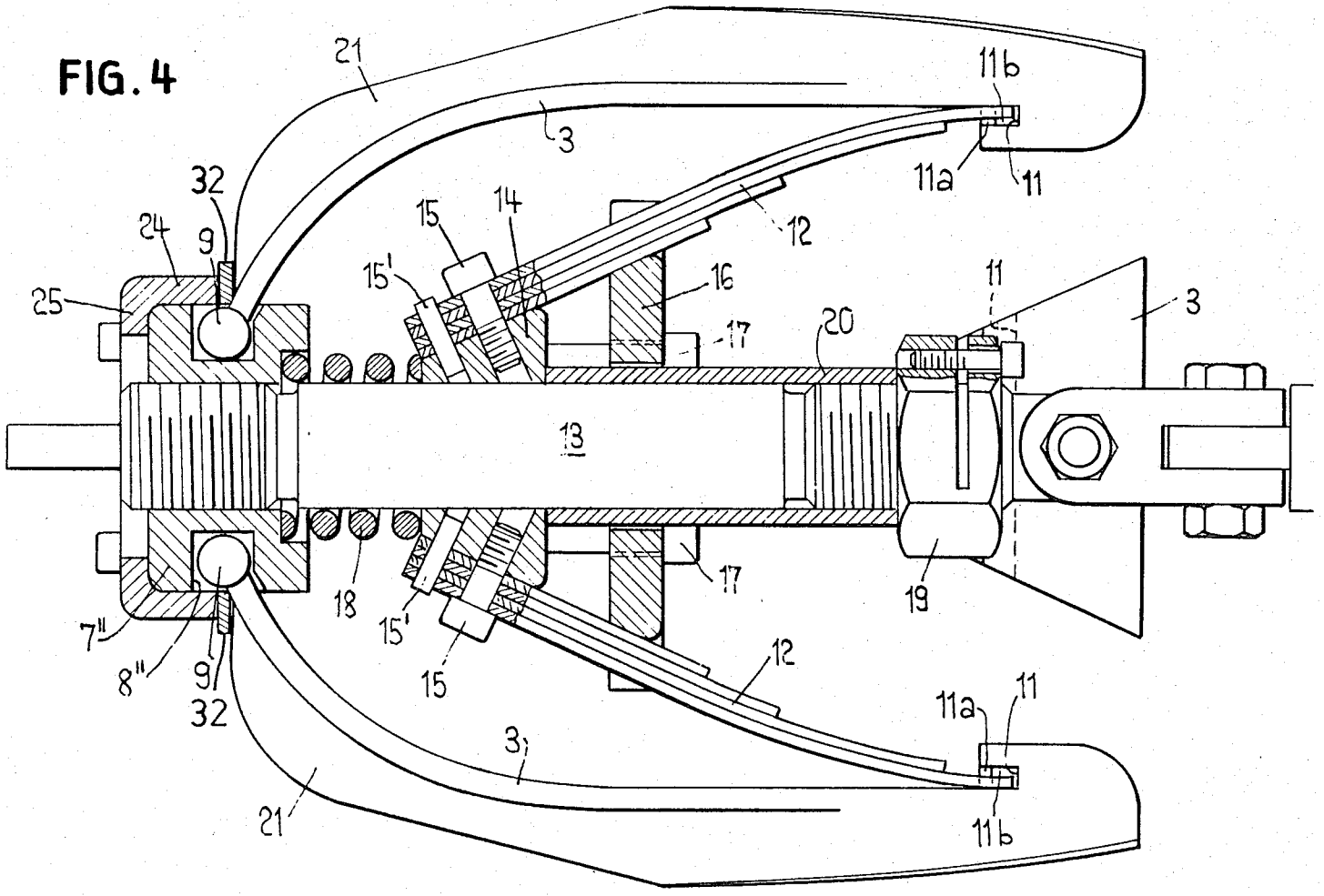
FIG. 4 is a partial section through a first embodiment.
Figure 5:
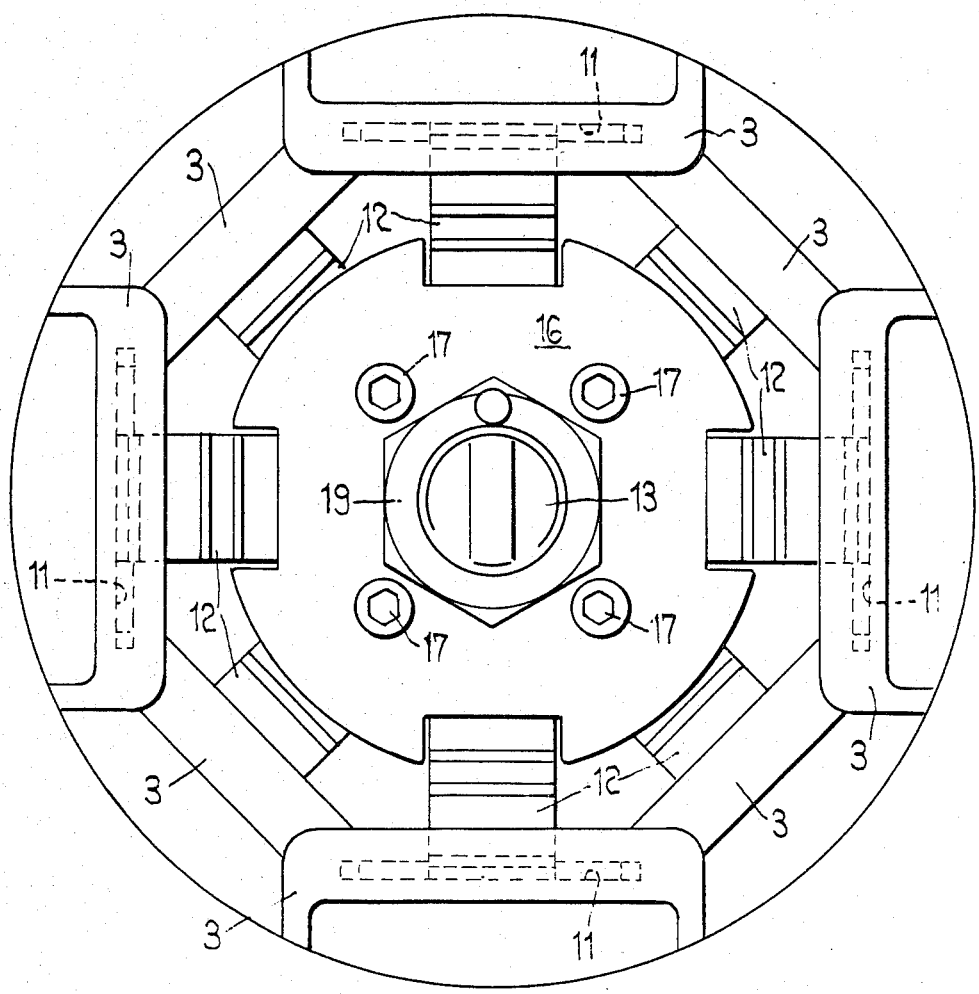
FIG. 5 is a rear view of the first embodiment.

FIGS. 4 and 5 show a modified embodiment, in which corresponding parts are designated as in FIG. 1. The difference substantially consists in the structure of the head wherein the cutter arms are anchored. This head 7'' has grooves 8'' of substantially rectangular cross section into which the cylindrical pivot pins 9 of the cutter arms engage. The pivot pins are secured by means of a flange 24 of a cup 25 removably screwed to the head 7''. As shown particularly in FIG. 4 the cutter arms extend in substantially radial direction from their anchorage in the head 7'' and form a steep front of the cleaning unit. The ribs 21 of the cutter arms form stops acting together with the rear face of the cup 25 for determining the radially outer end position of the cutter arms which substantially corresponds to the nominal diameter of the cleaning unit. This limitation of the outward movement of the cutter arms is of considerable importance for instance when cleaning pipes of weak and brittle material such as plastic material, asbestos, cement or the like. The stop position may be adjusted by inserting adapter stop rings 32 between the cup 25 and the ribs 21.

As shown in FIG. 5, the cutter arms 3 of the cleaning units are staggered by 45°.

As indicated in FIG. 4 the pivot pins 9 are also anchored with radial play. Further, the anchoring grooves 11 are laterally closed by a welding bead or alternatively a welded or screw-fixed element **11*a* is attached thereto so that pockets are formed wherein the spring is laterally guided. However, the bottom of each groove or pocket is visible through a window 11*b*** such that the position of the spring end may be observed and checked. The spring end should be spaced from the bottom of the groove by about 1 to 2 mm if the unloaded cutter arm is in a position corresponding to the nominal diameter of the tube and cleaning equipment respectively.

Figure 6:
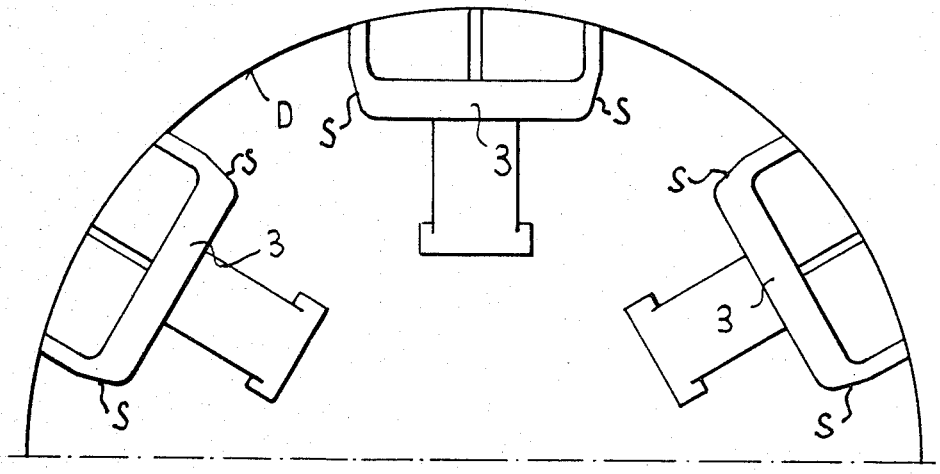
FIGS. 6 and 7 are schematic rear views of a second embodiment of the invention.
Figure 7:
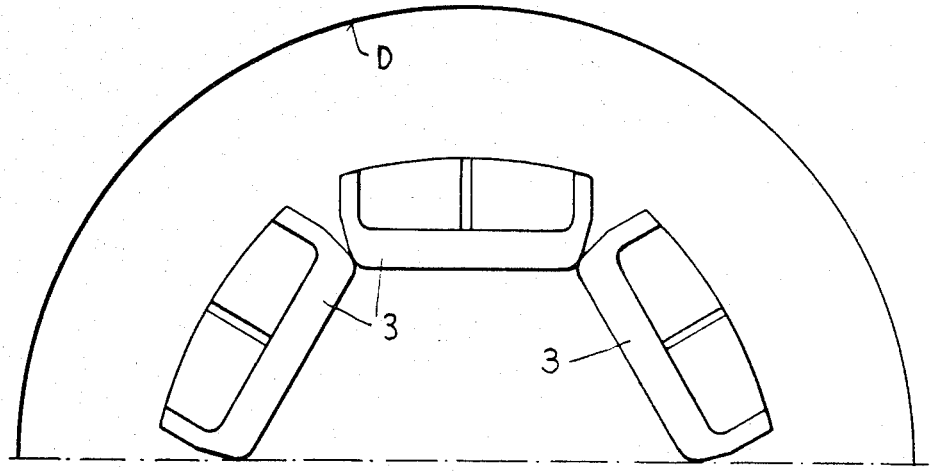

FIGS. 6 and 7 schematically show a second modified embodiment. For the sake of simplicity, the shape and position of the cutter arms only is illustrated. Otherwise, the construction is similar to the one shown in FIGS. 4 and 5. In the region of the diverging knives and at least at their widest rear end such arms have a relatively deep section with inwardly tapering outer surfaces as shown at S. If the cutter arms are cast, shaping in this way is not difficult. As shown in FIG. 7, the cutter arms may be pivoted inwardly by an appreciable angle in spite of the fact that six arms are provided, it thus being possible to collapse the cleaning units to a small diameter, whereby they may easily be moved through narrow and/or bent pipe portions. Inward displacement of the cutter arms by an appreciable angle is favored by the fact that such arms reach their full radial extension from the axis of the units outside the anchoring and supporting structures 14 to 17, as particularly shown in FIG. 4. FIG. 7 further shows that even with fully collapsed cutter arms no portions thereof radially extend beyond the V-shaped diverging knives thereof. This is due to the straight, inwardly inclined shape of the outer edge of ribs 21 in the region A, and this also favors easy passage of the cleaning equipment through bent pipe sections as set out above.

Instability of the cleaning equipment by tilting or inclination of its axis relatively to the tube axis often creates problems. The tendency for such an instability is increased by the fact that the cleaning equipment is pushed by the propelling unit. Satisfactory stability and at the same time high cleaning power is obtained if the V-shaped diverging knives of the cutter arms are relatively long. While in the prior art mentioned above the axial length of these knives is only of the order of one third of the whole axial length of the cutter arms, this length of the knives is of the order of half the whole axial length of the cutter arms or substantially equal to half the nominal diameter D in the embodiments described hereinbefore. This not only contributes to a stabilisation of the position of the cleaning equipment, but a particularly high cleaning effect is obtained by the uniform contact of the V-shaped knives on the pipe walls and the low tendency of lateral displacement.

Stabilization of the cleaning equipment in the pipe is also improved by the fact that the propulsion force is not applied behind but within the cutting arms. This not only improves the stability but the compactness of the cleaning equipment and its ability to pass through bent pipe portions.

Due to the fact that the cutting arms engage into the heads 7 rather in a radial than in an axial direction, it is possible to use heads of relatively small size and weight, this further improving the stability.

In the region A of the cutting arms shown in FIG. 2 one or more rollers 30, for instance up to four rollers, may be provided. These rollers, which may preferably be used on cleaning equipment having nominal diameters exceeding 1 m, facilitate passage of the cleaning equipment through narrow sections for instance through the openings of sliding valves of which the clearance is smaller than the nominal diameter of the pipe to be cleaned. The rollers also assist passage through bent pipe portions without affecting the cleaning efficiency.

Instead of a propelling unit pushing the cleaning equipment, another driving system may be provided. As an example, the cleaning equipment may be pulled through the pipe to be cleaned by means of a rope.

What is claimed is:

1. A pipe cleaning apparatus for a pipe having a pipe wall with a nominal inner diameter comprising:

at least one propulsion unit for moving said apparatus within the interior of the pipe; and a cleaning unit for removing deposits from the pipe wall, said cleaning unit having an opposed hinged connection with said propulsion unit operable to permit said cleaning unit at least two degrees of freedom of movement with respect to said propulsion unit for passage of both units through bends in the pipe, said cleaning unit having an axial length and a nominal outer diameter both approximately equal to the pipe nominal inner diameter, said cleaning unit including:

a head member;

a plurality of rigid cutter arms each having an axial length approximately equal to the pipe nominal inner diameter as well as a first end pivotally connected to said head member at a pivotal connection so that said cutter arms are operable to pivot in a generally radial direction with respect to said head member, a peripheral edge of said cutter arms defining said cleaning unit nominal outer diameter, each of said cutter arms also having second ends distal said first ends;

means for biasing said cutter arms radially outwardly with respect to said head member for maintaining contact between the pipe wall and said cleaning unit while said cleaning unit is maneuvered through the bends; and said head member also limiting said cleaning unit outer diameter to approximately equal to said cutter arm axial length and the pipe nominal inner diameter.

2. The apparatus according to claim 1 wherein each cutter arm has a radially outer contour and a radial rib extending from said pivotal connection along at least a portion of said outer contour.

3. The apparatus according to claim 2, where said radial rib includes a branch juncture where said radial rib branches into two end rib portions forming a V-shaped cutting edge.

4. The apparatus according to claim 3, wherein said cutter arms end rib portions decrease in thickness from said branch juncture towards a distal end thereof.

5. The apparatus according to claim 2 or 3, wherein said radial rib extends radially outwardly and defines a front radial rib edge proximate said first end pivotal connection.

6. The apparatus according to claim 5, wherein said radial rib has a substantially straight outer edge between said pivotal connection and said branch juncture.

7. The apparatus according to claim 5 wherein said cutter arm pivotal connections are pivot pins that engage in head grooves defined by said head member, said grooves being partially covered by a retaining member cooperating with said head member for retaining said pivot pins in said grooves, said radial rib front edges abutting said retaining member so as to form a stop to limit radial extension of said cutter arms.

8. The apparatus according to claim 24 wherein a gap is defined between said pivot pins and said head grooves to allow circumferential and twisting translation of said cutter arms relative said head.

9. The apparatus according to claim 7 wherein said retaining member is a cup removably mounted on said head member.

10. The apparatus according to claim 9 wherein a separate stop adapter ring is interposed between said cup and said radial rib front edges.

11. The apparatus according to claim 3, wherein said end rib portions of each cutter arm define a groove proximate said branch juncture.

12. The apparatus according to claim 3, wherein said V-shaped cutting edge defines an axial length at least approximately half the axial length of the cutter arms.

13. The apparatus according to claim 3, wherein each cutter arm has a number of rollers attached to said rib between said pivotal connection and said V-shaped cutting edge.

14. The apparatus according to claim 1, wherein said cutter arms are cast steel.

15. The apparatus according to claim 1 wherein said biasing means comprises a plurality of leaf springs supported adjacent said head member, said springs respectively extending to a radially outer end of each of said plurality of cutter arms.

16. The apparatus according to claim 15, wherein each cutter arm has a pocket formed therein and an end of at least one leaf spring engages into said pocket of an associated cutter arm and is anchored therein against radial and circumferential displacement, said pocket having a bottom and at least one lateral window through which the relative position between said end of said spring and said pocket may be observed.

17. The apparatus according to claim 16 where said leaf spring end extends to a distance of between approximately 1 to 2 mm from said bottom of said pocket when said cutter arms are in a position corresponding to the nominal diameter of said cleaning unit and the pipe.

18. The apparatus according to claim 15 wherein said head member is connected to a shaft that is in turn connected to said propulsion unit, said springs are connected to said shaft proximate an axial location corresponding to that of an end of each of said cutter arms distal said pivotal connection.

19. The apparatus according to claim 1, wherein said cutter arms have a substantially triangular cross section for imparting thereto a high torsional strength.

20. The apparatus according to claim 1, wherein at least a portion of said hinged connection is located between and within the axial length of said cutter arms.

* * * * *